US008905264B2

(12) United States Patent
White et al.

(10) Patent No.: US 8,905,264 B2
(45) Date of Patent: Dec. 9, 2014

(54) NOZZLE ASSEMBLY

(75) Inventors: Robert W. White, Midland Park, NJ (US); Paul Gertner, Brooklyn, NY (US)

(73) Assignee: Starborn Industries, Inc., Edison, NJ (US)

( * ) Notice: Subject to any disclaimer, the term of this patent is extended or adjusted under 35 U.S.C. 154(b) by 419 days.

(21) Appl. No.: 12/658,989

(22) Filed: Feb. 18, 2010

(65) Prior Publication Data

US 2011/0198372 A1 Aug. 18, 2011

(51) Int. Cl.

| | |
|---|---|
| ***B67D 3/00*** | (2006.01) |
| ***B65D 47/06*** | (2006.01) |
| ***B05C 17/005*** | (2006.01) |
| ***B05C 7/00*** | (2006.01) |
| ***B05C 7/06*** | (2006.01) |

(52) U.S. Cl.

CPC ..... *B05C 17/00503* (2013.01); *B05C 7/00* (2013.01); *B05C 7/06* (2013.01)

USPC ..... 222/1; 222/514; 222/513; 222/518; 141/296

(58) Field of Classification Search

CPC ... E04G 23/0203; B65D 47/283; B67D 7/005

USPC ..... 222/514, 513, 482, 568, 1; 405/269; 52/744, 742.13; 141/257, 352; 118/306

See application file for complete search history.

(56) References Cited

U.S. PATENT DOCUMENTS

| | | | | | |
|---|---|---|---|---|---|
| 525,744 | A | * | 9/1894 | Roth | 141/292 |
| 1,883,196 | A | * | 10/1932 | Wertz | 264/36.2 |
| 3,949,561 | A | * | 4/1976 | Chapman | 405/266 |
| 4,509,884 | A | * | 4/1985 | Trout et al. | 405/269 |
| 4,834,151 | A | * | 5/1989 | Law | 141/198 |
| 4,979,655 | A | * | 12/1990 | Gallucci | 222/519 |
| 5,010,841 | A | * | 4/1991 | Stewart | 118/711 |
| 5,076,333 | A | * | 12/1991 | Law | 141/198 |
| 6,435,380 | B1 | * | 8/2002 | Raboin | 222/484 |
| 6,478,058 | B1 | * | 11/2002 | Pears | 141/353 |
| 6,598,630 | B1 | * | 7/2003 | Trippi, Jr. | 141/350 |
| 7,278,557 | B2 | * | 10/2007 | Rackwitz | 222/402.15 |
| 8,042,715 | B2 | * | 10/2011 | Charlier et al. | 222/514 |
| 2001/0042764 | A1 | * | 11/2001 | Baldwin | 222/513 |

FOREIGN PATENT DOCUMENTS

| | | |
|---|---|---|
| DE | 3226956 | 1/1984 |
| EP | 1378332 A2 | 1/2004 |

* cited by examiner

*Primary Examiner* — Paul R Durand
*Assistant Examiner* — Charles P Cheyney

(57) ABSTRACT

A nozzle assembly includes an inner tubular member having a closed end and an opposed open end for receiving a fluid from a source, at least one outlet extending radially through the inner tubular member proximate the closed end, wherein the closed end is configured for insertion into a bore defined by a sidewall in a work piece. The nozzle assembly further includes a slidably movable outer sleeve, having a distal end, disposed around the inner tubular member, wherein the distal end is configured for contact with an exterior edge portion of the bore. The outer sleeve is normally biased to a first position sealing the at least one outlet from the exterior, and slidably movable to a second position unsealing the at least one outlet upon contact with the edge portion of the bore as the closed end of the inner tubular member is inserted into the bore.

17 Claims, 6 Drawing Sheets

NOZZLE ASSEMBLY

FIELD OF THE INVENTION

The present invention relates to fluid dispensing nozzles, and more particularly a nozzle assembly adapted for dispensing a fluid into a bore or aperture in a selectively controlled manner.

BACKGROUND OF THE INVENTION

Carpenters frequently use a common technique that involves countersinking screws into a work piece (e.g., patio decks), and using a plug to conceal the countersunk screw head. The technique produces a clean and smooth surface, which provides both functional and aesthetic benefits. The plug concealing the screw head is securely retained within the countersunk bore or aperture by a glue or adhesive compound. The plug is inserted into the bore preferably with the top surface flush with the surface of the work piece. The carpenter must ensure that the size and shape of the plug matches the bore. The carpenter must also ensure that only a very small amount of glue is dispensed into the bore to provide good adhesion, while preserving the fit.

Similarly, carpenters also use dowel pins to join two disparate work pieces together. Each of the work pieces includes a bore in which an adhesive is applied therein prior to joining with a dowel pin.

Ideally, the adhesive should be applied to the sides of the bore with very little at the screw head or at the bottom of the bore for dowel pins. In practice, however, the amount of glue applied is imprecise. Conventional nozzles usually dispense in a manner resulting in excessive amounts, which appears at the bottom of the bore. Alternatively, the adhesive may be applied to the plug and inserted into the bore. These methods present several problems, which the present invention is designed to solve.

The holding power of the glue is almost entirely a function of its application on the sidewall of the bore, so that having the glue predominantly residing on the bottom of the bore provides little adhesive strength. Additionally, the pooling of the glue can result in a hydraulic lock effect, which limits the insertion depth of the plug or dowel pin. As a result, the plug is poorly seated within the bore, requiring sanding and cutting to produce a flush, smooth surface. In the alternative, applying glue directly onto the plug is messy and result in excess glue on work surfaces, tools and the like, thus requiring extra clean-up and/or sanding. Accordingly, the process of countersinking screws and plugging the bore and joining work pieces via dowel pins are labor intensive and great care must be taken to produce a functional bond along with a smooth and unmarred surface.

In view of the foregoing problems, there is a need for a nozzle assembly designed to dispense a precise amount of a fluid to a side portion defining a bore or aperture in a work piece, while minimizing undesirable overflows and/or fluid at the bottom of the bore.

SUMMARY OF THE INVENTION

The present invention relates generally to a nozzle assembly designed to dispense a precise amount of a fluid to the side of a bore or aperture in a work piece, while minimizing undesirable overflows and/or deposition of fluid at the bottom of the bore. The nozzle assembly of the present invention enables the application or dispensing of a uniform coating or film of the fluid directly to the side portion of the bore. The nozzle assembly of the present invention includes an inner tubular member having a closed end and an opposed open end for receiving a fluid from a fluid source, at least one outlet extending radially through the inner tubular member proximate the closed end, wherein the closed end is configured for insertion into a bore defined by a sidewall in a work piece.

The nozzle assembly of the present invention further includes a slidably movable outer sleeve, having a distal end, disposed around the inner tubular member, wherein the distal end is configured for contact with an exterior edge portion of the bore. The outer sleeve is normally biased to a first position sealing the at least one outlet from the exterior, and slidably movable to a second position unsealing the at least one outlet upon contact with the edge portion of the bore as the closed end of the inner tubular member is inserted into the bore.

In one aspect of the present invention, there is provided a nozzle assembly, which comprises:

an inner tubular member having a closed end and an opposed open end for receiving a fluid from a source;

at least one outlet extending radially through the inner tubular member proximate the closed end, the closed end being configured for insertion into a bore defined by a sidewall in a work piece;

a slidably movable outer sleeve, having a distal end, disposed around the inner tubular member, the distal end being configured for contact with an exterior edge portion of the bore; and the outer sleeve being normally biased to a first position sealing the at least one outlet from the exterior, and slidably movable to a second position unsealing the at least one outlet upon contact with the edge portion of the bore as the closed end of the inner tubular member is inserted into the bore.

BRIEF DESCRIPTION OF THE DRAWINGS

The following drawings are illustrative of embodiments of the present invention and are not intended to limit the invention as encompassed by the claims forming part of the application.

DETAILED DESCRIPTION OF THE INVENTION

The present invention relates generally to a nozzle assembly designed to dispense a precise amount of a fluid to the side of a bore or aperture in a work piece, while minimizing undesirable overflows and/or deposition of fluid at the bottom of the bore. The nozzle assembly of the present invention enables the application or dispensing of a uniform coating or film of the fluid directly to the side portion of the bore.

Generally, the nozzle assembly of the present invention includes an inner tubular member having a closed end and an opposed open end for receiving a fluid from a fluid source, at least one outlet extending radially through the inner tubular member proximate the closed end, wherein the closed end is configured for insertion into a bore defined by a sidewall in a work piece.

The nozzle assembly of the present invention further includes a slidably movable outer sleeve, having a distal end, disposed around the inner tubular member, wherein the distal end is configured for contact with an exterior edge portion of the bore. The outer sleeve is normally biased to a first position sealing the at least one outlet from the exterior, and slidably movable to a second position unsealing the at least one outlet upon contact with the edge portion of the bore as the closed end of the inner tubular member is inserted into the bore.

Figure 1:
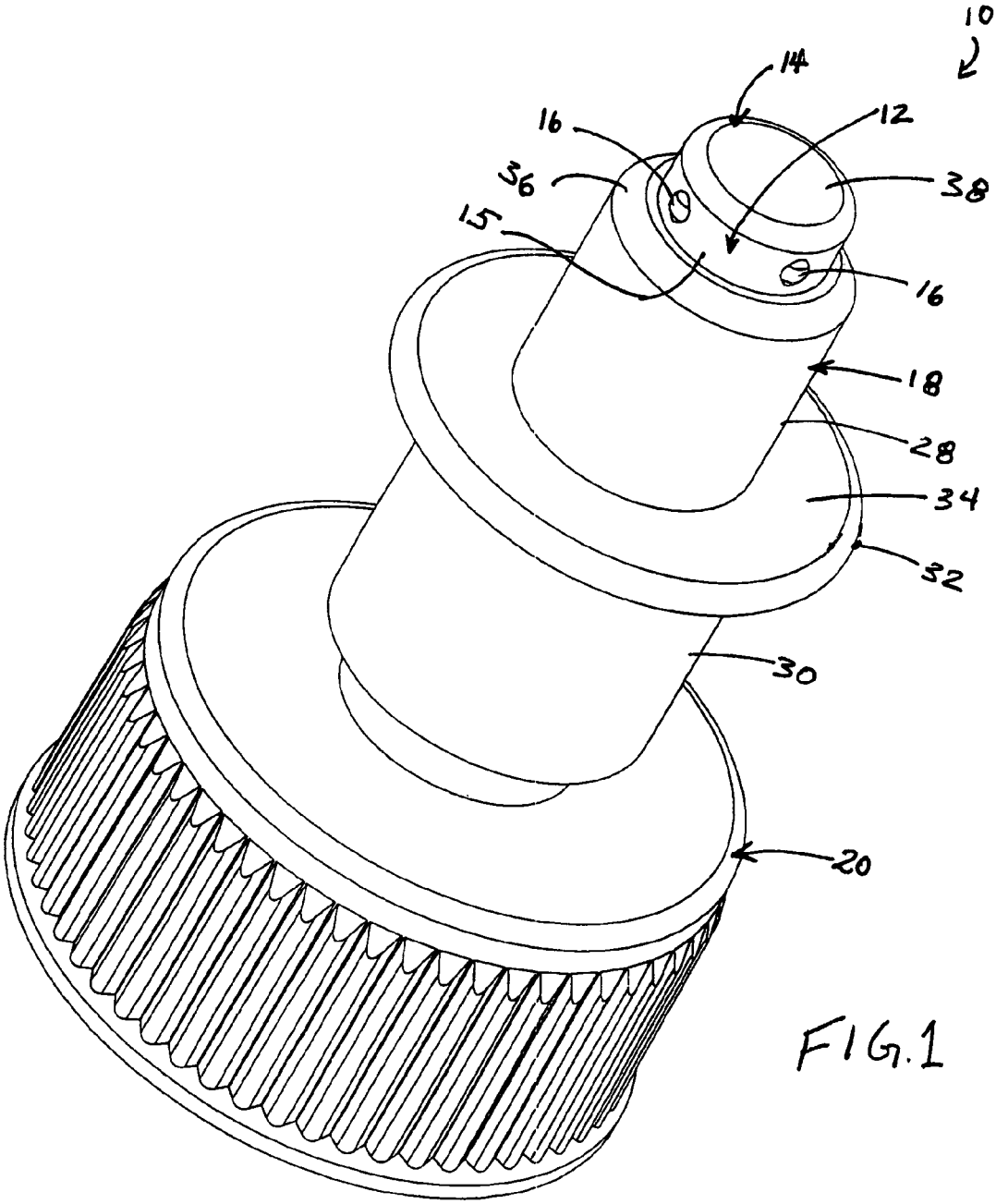
FIGS. 1 and 2 are top perspective views of a nozzle assembly in sealed and unsealed positions, respectively, for one embodiment of the present invention.
Figure 2:
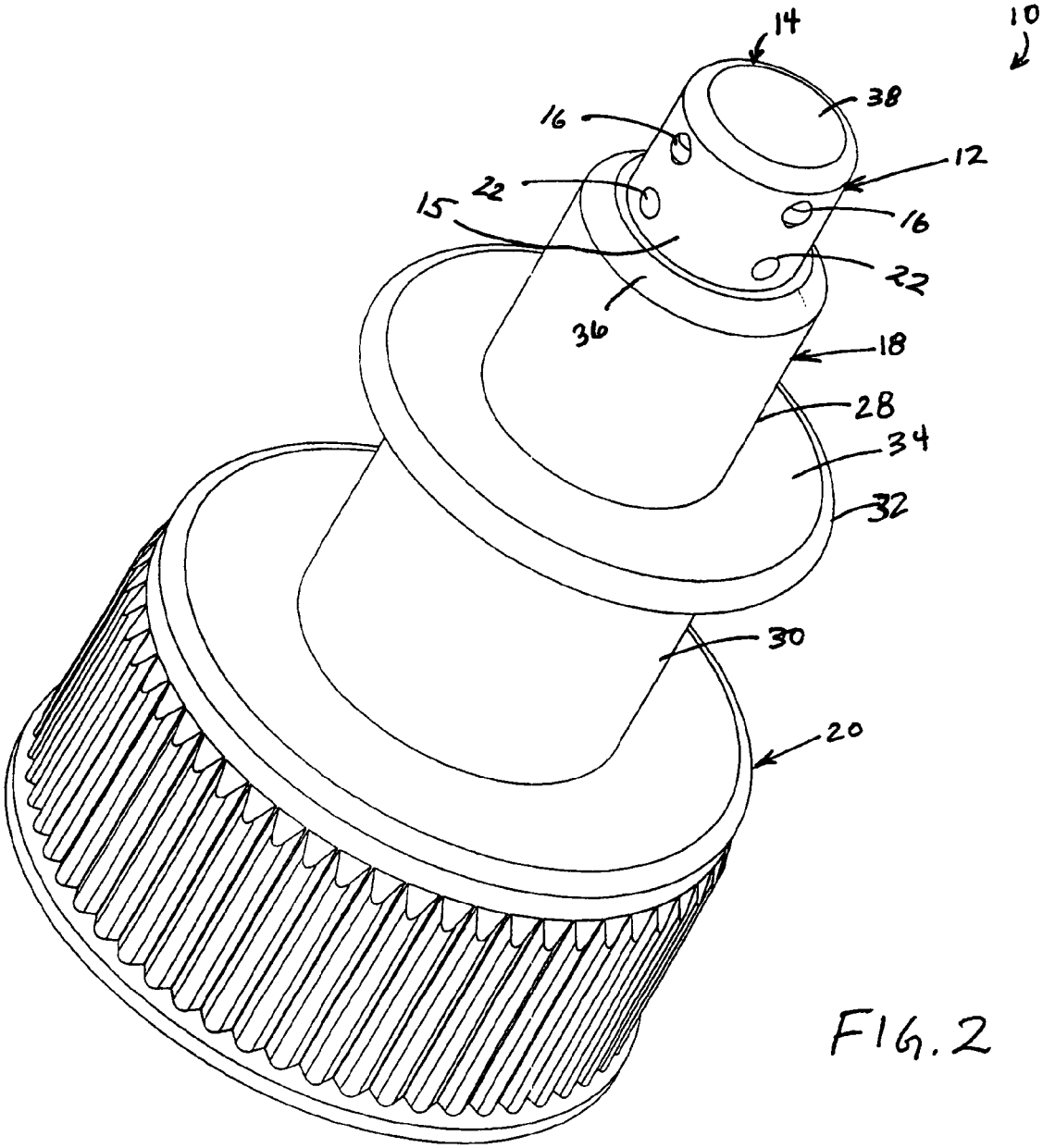

Referring to FIGS. 1 and 2, a nozzle assembly, identified generally by reference numeral 10 is shown for one embodiment of the present invention. The nozzle assembly 10 is adapted for insertion into a bore 60 of a work piece 62 (see FIG. 5). The bore 60 has a bottom portion 68 and sidewall portions 66 (e.g., cylindrical shaped sidewall). The nozzle assembly 10 is adapted to dispense a fluid (e.g., adhesive or glue) in a consistent and controlled manner. The nozzle assembly 10 is further adapted for attachment to a suitable fluid container or source 80 (see FIG. 5) to supply the fluid for dispensing as will be described hereinafter. Although the nozzle assembly 10 can be used in the context of applying an adhesive or glue within a countersunk bore, the present invention is not limited to such application and may be used in any application where the intent is to apply or dispense a fluid onto an interior surface, preferably the sides, of a bore, in a substantially uniform and consistent manner. The fluid dispensed may be viscous or free-flowing.

The nozzle assembly 10 may be constructed of any suitable material including, but not limited to, plastic polymers such as, for example, polypropylene and polyethylene. It will be understood that the size, shape and configuration of the nozzle assembly of the present invention is not limited to the form as shown and described herein, and may be modified to include other shapes and configurations for precise dispensing of fluid to the sidewall portions 66 of the bore 60 (see FIG. 5).

The nozzle assembly 10 includes an inner tubular member 12 having a interior cavity 26 (see FIG. 3) for conveying a fluid therethrough, a closed end 14 with an end surface 38, a plurality of nubs or protrusions 16 projecting outwardly in a radially spaced-apart arrangement, and a plurality of outlets 22 disposed radially spaced apart from one another (see FIG. 3) proximate the closed end 14. The nubs 16 and outlets 22 are positioned on a side radial surface 15 of the closed end 14. In the specific embodiment shown, four nubs 16 and four outlets 22 are employed. The nubs 16 are configured to contact the sidewall portions 66 of the bore 60 and ensure that the closed end 14 of the inner tubular member 12 is centered within the bore 60.

Figure 6:
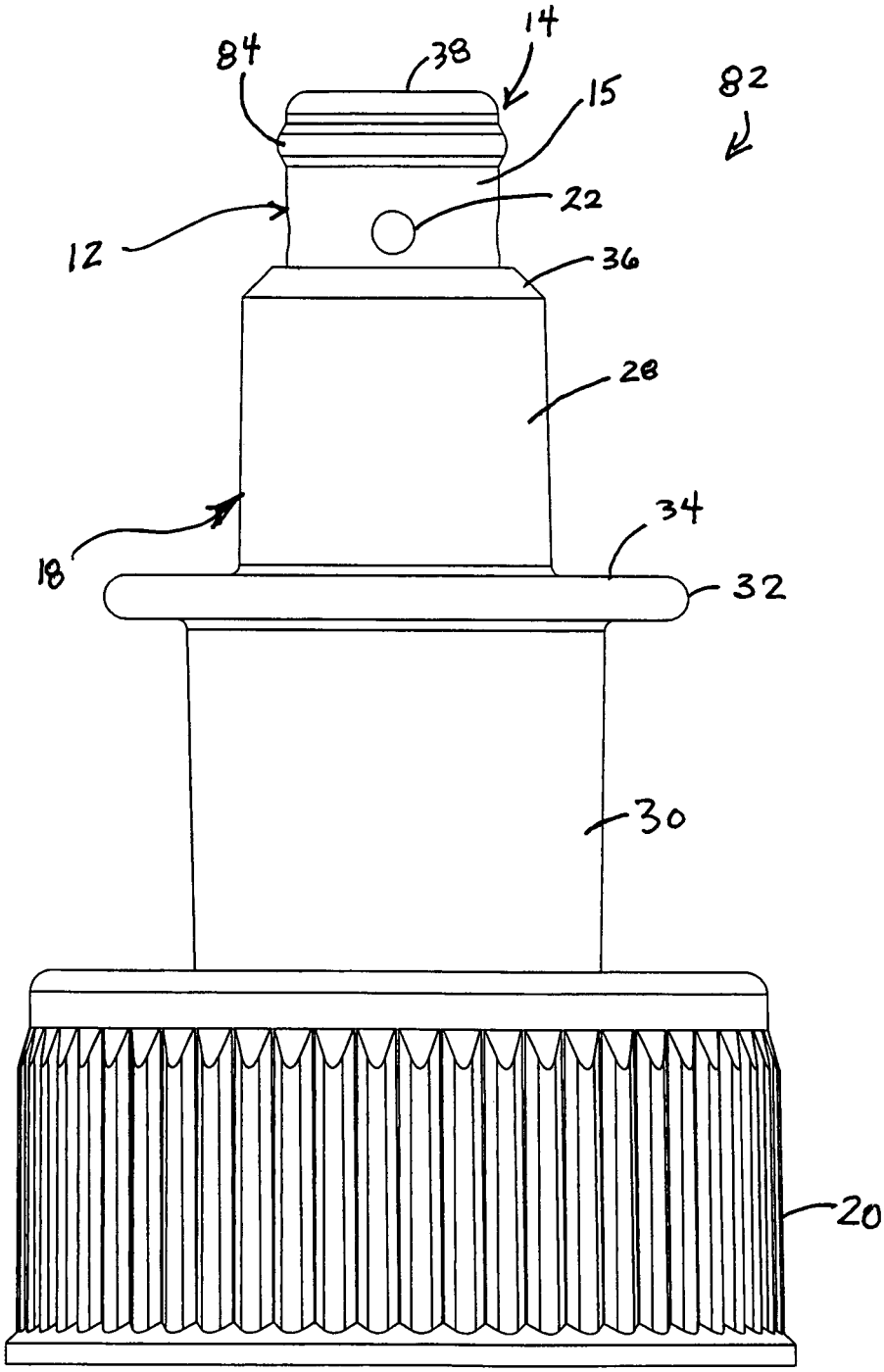
FIG. 6 is an elevational view of a nozzle assembly in accordance with another embodiment of the present invention.

It will be understood that the number and form of the nubs 16 is not limited to the configuration shown, and may include other numbers and configurations such as, for example, in the form of a circumferential protrusion or ring. In reference to FIG. 6, a nozzle assembly 82 is shown for an alternative embodiment of the present invention. The nozzle assembly 82 is similar to the nozzle assembly 10 apart from a single circumferential ring 84 extending peripherally along the side radial surface 15 of the inner tubular member 12. In this embodiment, when the nozzle assembly 82 is drawn up through the bore 60 after dispensing the glue, the ring 84 leaves a thin film of glue around the bore 60 even though a portion of the glue dispensed may be lifted up by the ring 84.

The closed end 14 is configured for insertion into the bore 60 and remains in the bore 60 as the fluid is dispensed therein via the outlets 22. The configuration of the nozzle assembly 10 ensures that the dispensed fluid is applied largely to the sidewall portion 66 defining the bore 60, while substantially preventing overflow onto the work piece 62 and/or application to the bottom portion 68 of the bore 60 as will be described hereinafter. It will be understood that the number, shape and positioning of the outlets 22 is not limited to the configuration shown, and may include other numbers, shapes and positions on the side radial surface 15 including, but not limited to, circular, rectangular, slotted, slit-like, and the like.

Figure 5:
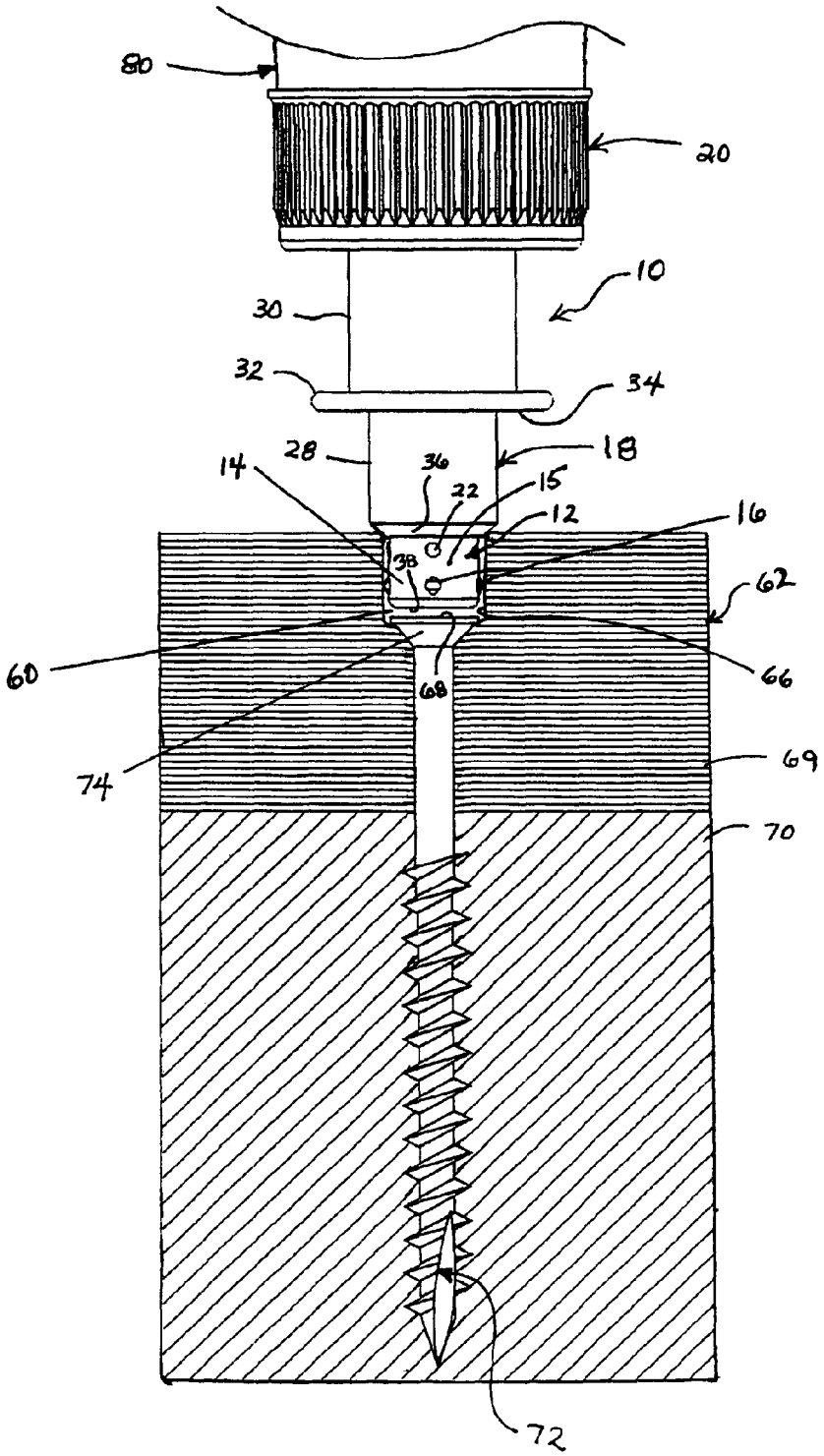
FIG. 5 is a side elevational view of the nozzle assembly inserted into a bore of a work piece (shown in cross section) during use in accordance with the present invention.

The nozzle assembly 10 further includes a slidably movable outer sleeve 18 operatively engaged to and surrounding the inner tubular member 12, and a threaded collar 20 located at the proximal end 54 thereof for facilitating attachment of the fluid source 80 thereto (as shown in FIG. 5). The outer sleeve 18 includes a distal end portion 28 with an edge or rim 36 extending therearound, a proximal end portion 30 and a radially extending flange portion 32 disposed between the proximal end portion 30 and the distal end portion 28. The outer sleeve 18 is configured to slidably move relative to the inner tubular member 12 from a sealed position where the distal end portion 28 seals off the outlets 22 (as shown in FIG. 1) to an unsealed position where the outlets 22 are open enabling fluid to flow therethrough (as shown in FIG. 2).

As the closed end 14 is inserted into the bore 60, the edge 36 of the distal end portion 28 is configured to contact the edge 64 of the bore 60 and to urge the outer sleeve 18 to the unsealed position for fluid dispensing (as shown in FIG. 5). In this manner, the outer sleeve 18 remains outside the bore 60. In a preferred embodiment of the present invention, the edge 36 is configured with a beveled or tapered configuration to facilitate a good contact with the external periphery of the bore 60, and may be composed of a resilient or elastic material, preferably non-porous material, such as polypropylene, polyethylene, and the like.

It will be understood that the edge 36 is not limited to a beveled or tapered configuration, and may be configured to include other shapes and/or contours including, but not limited to, a flat configuration, a stepped or grommet-like configuration, a rounded configuration, a fillet configuration, and the like.

The outer sleeve 18 may be normally spring-biased to the sealed position. Thus, when the closed end 14 is withdrawn from the bore 60, the outlets 22 are automatically sealed shut from further dispensing to prevent overflow on the work piece 62. The flange portion 32 further defines a surface 34 which the user can press to manually move the outer sleeve 18 to the unsealed position, if desired.

Figure 3:
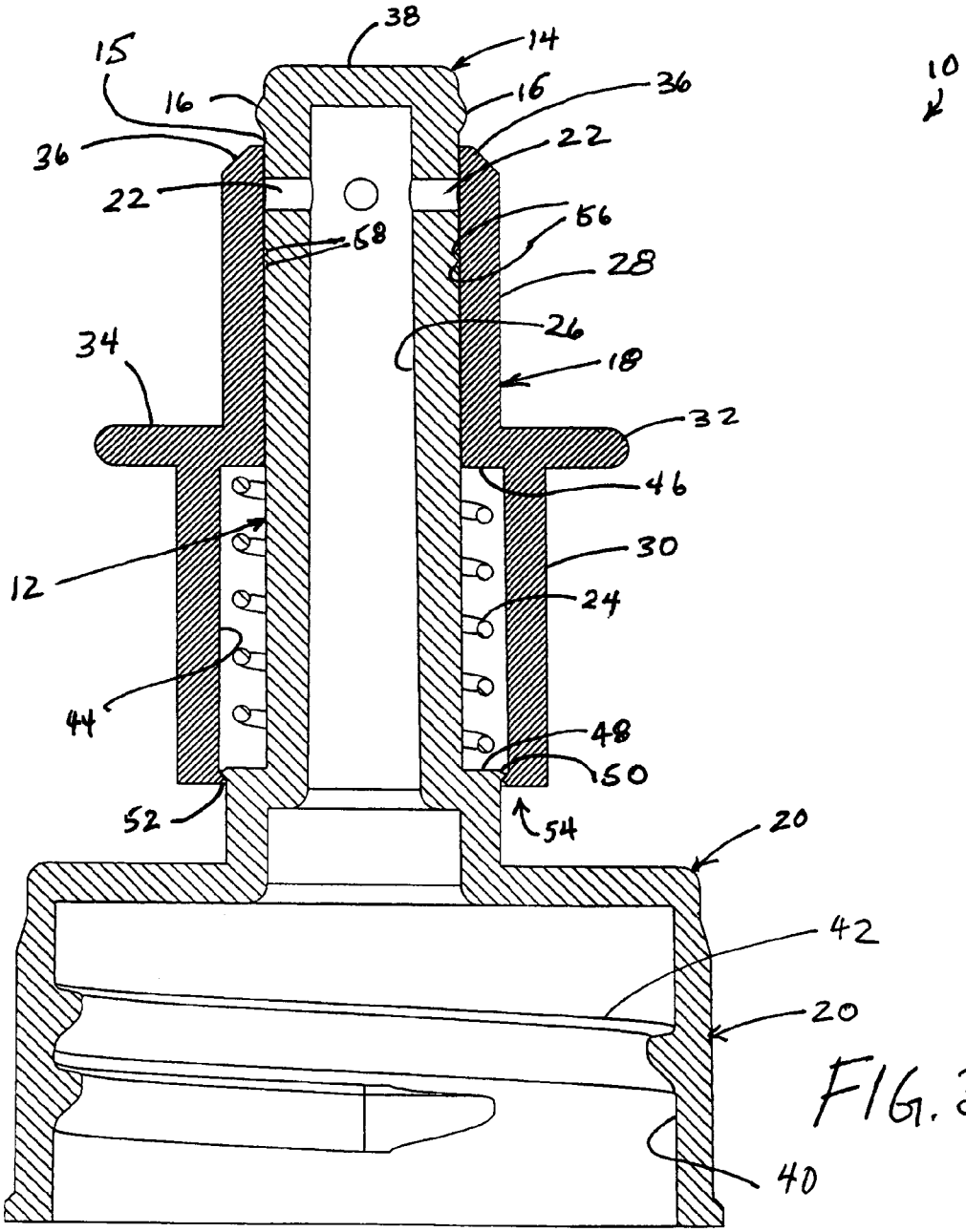
FIGS. 3 and 4 are side cross sectional views of the nozzle assembly in the sealed and unsealed positions, respectively, in accordance with the present invention.
Figure 4:
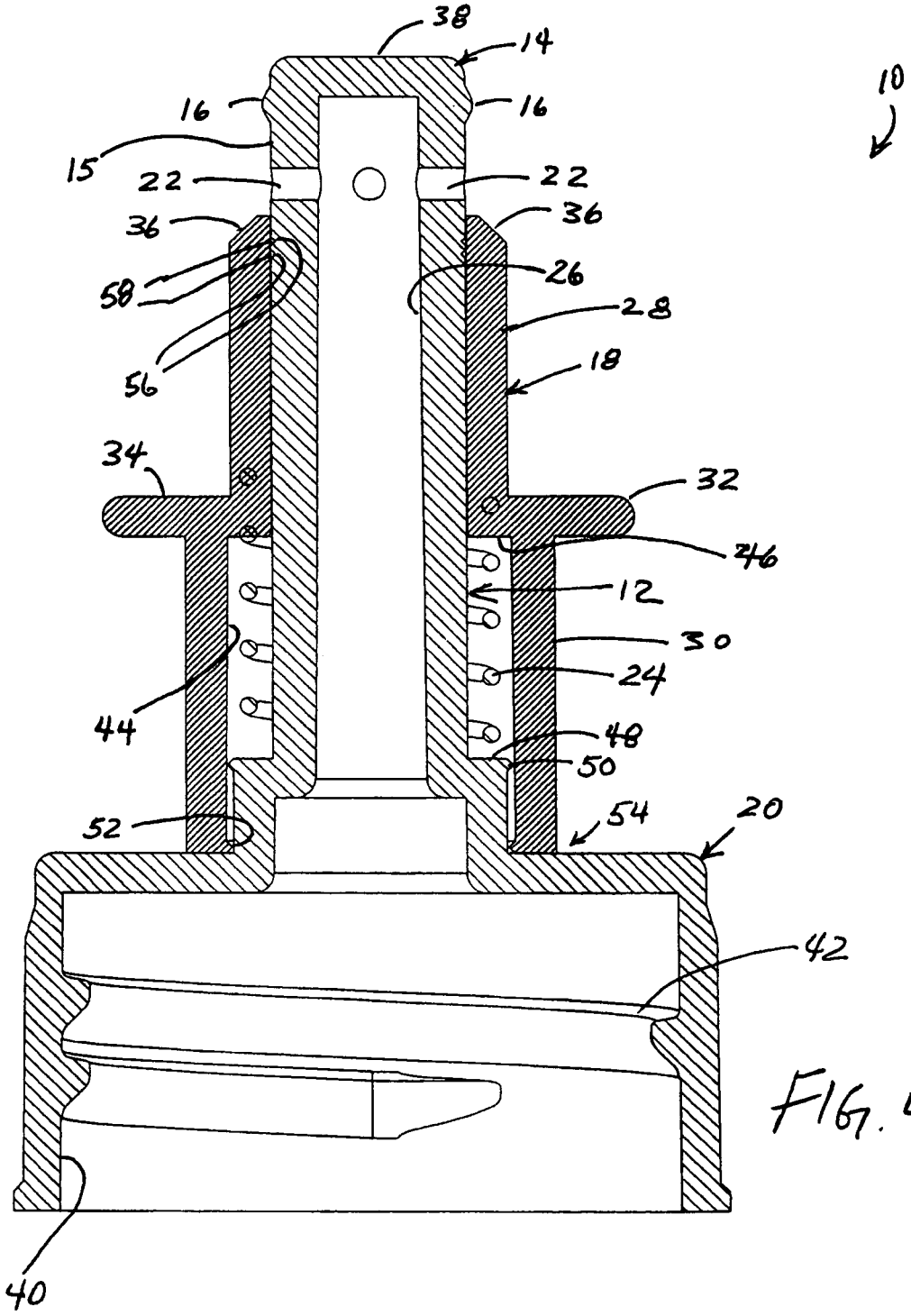

Referring to FIGS. 3 and 4, the interior cavity 26 of the inner tubular member 12 fluidly connects the outlets 22 to an interior area 40 of the collar 20. The interior area 40 includes internal threads 42 for receiving an externally threaded spout (not shown) of the fluid source 80 for threaded engagement therebetween. Once threaded connection to the fluid source 80 is established, the fluid is free to flow from the fluid source 80 to the interior cavity 26 of the nozzle assembly 10. The fluid may flow from the fluid source 80 through the interior cavity 26 through gravity or user applied force.

In the present embodiment of the present invention, the outlets 22 and the nubs 16 are disposed on the closed end 14 of the inner tubular member 12 in a radially spaced apart arrangement (e.g., ninety degrees from one another when four nubs and four outlets are used). The nubs 16 positioned on the side radial surface 15 between the outlets 22 and the end surface 38 remain exposed with the outer sleeve 18 in the sealed position. The distal end portion 28 of the outer sleeve 18 is configured for close fitting contact with the inner tubular member 12 to establish sliding engagement therebetween.

The proximal end portion 30 of the outer sleeve 18 is spaced apart from the inner tubular member 12 to define a toroidal-shaped cavity 44 therebetween. The cavity 44 houses a spring 24 therein. The spring 24 is operatively engaged between the inside surface 46 of the outer sleeve 18 and the base 48 of the inner tubular member 12. The spring 24 normally urges the outer sleeve 18 to the sealed position.

The base 48 of the inner tubular member 12 further includes a circumferential rib 50 extending peripherally therearound. When the outer sleeve 18 is at the sealed position, the circumferential rib 50 engages a corresponding circumferential rib 52 disposed at the proximal end 54 of the outer sleeve 18. The engagement ensures that the outer sleeve 18 is retained securely to the inner tubular member 12. The inner tubular member 12 further includes at least one groove 56 extending peripherally therearound to receive and retain an O-ring 58 therein. The O-ring 58 provides a fluid seal in the spacing between the inner tubular member 12 and the outer sleeve 18. This prevents the fluid passing through the outlets 22 from seeping into the cavity 44.

Referring to FIG. 5, the nozzle assembly 10 attached to a fluid source 80 (i.e., container) is shown in use. The collar 20 of the nozzle assembly 10 is threadedly connected to the fluid source 80. The work piece 62 is composed of upper and lower parts 69 and 70, respectively, fastened together via a screw 72. The head 74 of the screw 72 defines the bottom portion 68 of the bore 60. The closed end 14 of the inner tubular member 12 is inserted into a bore 60 of the work piece 62. As the closed end 14 is inserted, the edge 36 located on the distal end portion 28 of the outer sleeve 18 contacts the exterior edge 64 of the bore 60 causing the outer sleeve 18 to move to the unsealed position relative to the inner tubular member 12.

With the closed end 14 inserted into the bore 60, the nubs 16 position the inner tubular member 12 at a predetermined distance from the sidewall portions 66 of the bore 60. The end surface 38 of the inner tubular member 12 is positioned slightly above or flat against the bottom portion 68 of the bore 60 as predetermined according to the application requirements. The nubs 16, acting as spacers, ensure that the closed end 14 of the inner tubular member 12 is centered within the bore 60. With the outlets 22 properly positioned within the bore 60, the fluid is dispensed directly onto the sidewall portions 66 of the bore 60. Once a sufficient amount of the fluid is dispensed, the closed end 14 is withdrawn from the bore 60, and the outer sleeve 18 is returned back to the sealed position resealing the outlets 22 to prevent further dispensing of the fluid into the bore 60.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for coating a sidewall of a cylindrical bore with a viscous fluid comprising:

a cylindrical bore defined by a bottom end, an upper end and a sidewall;

a source of a viscous fluid;

a nozzle assembly insertable into the cylindrical bore and proximate the sidewall comprising an inner tubular member having a closed end and an opposed open end for receiving said viscous fluid from said viscous fluid source and, at least one outlet extending radially through the inner tubular member for directing said viscous fluid radially toward the sidewall, said at least one outlet being positioned sufficiently proximate to the sidewall of the cylindrical bore so that a substantial amount of the viscous fluid directly contacts the sidewall to form a permanent coating of the viscous fluid thereon;

a slidably movable outer sleeve, having a distal end, disposed around the inner tubular member, said distal end dimensioned for overlapping contact with an exterior edge portion of the upper end of the cylindrical bore when said viscous fluid flows radially through said at least one outlet; and said outer sleeve being normally biased to a first position sealing said at least one outlet from the exterior, and slidably movable to a second position unsealing said at least one outlet while providing sealing overlapping contact with the edge portion of the cylindrical bore as the closed end of the inner tubular member is inserted into the cylindrical bore, wherein the fluid flows radially through said at least one outlet to thereby contact the sidewall of the cylindrical bore contiguous with the position of the inner tubular member within the cylindrical bore to provide said coating while said viscous fluid is prevented from flowing beyond the upper end of the cylindrical bore by the overlapping contact seal formed between the outer sleeve and the edge portion of the cylindrical bore and from flowing away from the sidewall.

2. The assembly method of claim 1 wherein the nozzle assembly further comprises:

a cavity defined by the inner and outer surfaces of the outer sleeve and inner tubular member respectively; and a spring disposed in said cavity operatively engaged between the outer sleeve and inner tubular member for urging the outer sleeve to the first position.

3. The method of claim 1 wherein the outer sleeve of the nozzle assembly further comprises a flange extending radially away from a middle portion thereof.

4. The assembly method of claim 1 wherein the nozzle assembly further comprises at least one protrusion extending radially from a side portion proximate the closed end of the inner tubular member.

5. The method of claim 4 wherein the at least one protrusion of the nozzle assembly is disposed between the at least one outlet and the closed end of the inner tubular member.

6. The method of claim 4 wherein the at least one protrusion of the nozzle assembly comprises a plurality of radially spaced apart nubs.

7. The method of claim 6 wherein the plurality of radially spaced apart nubs of the nozzle assembly comprise four nubs spaced apart by 90 degrees from one another.

8. The method of claim 1 wherein the distal end of the outer sleeve of the nozzle assembly comprises a beveled edge extending therearound.

9. The method of claim 1 wherein the distal end of the outer sleeve of the nozzle assembly comprises a resilient material.

10. The method of claim 1 wherein the open end of the inner tubular member of the nozzle assembly comprises a threaded collarfor threaded engagement to the viscous fluid source.

11. The method of claim 1 wherein the at least one outlet of the nozzle assembly comprises a plurality of radially spaced apart outlets.

12. The method of claim 11 wherein the plurality of radially spaced apart outlets of the nozzle assembly comprise four outlets spaced apart by 90 degrees from one another.

13. The method of claim 1 wherein the nozzle assembly further comprises:

an external circumferential rib extending along the inner tubular member proximate the open end thereof; and an internal circumferential rib extending along the inside surface of the outer sleeve proximate the proximal end thereof for operative engagement with the external circumferential rib of the inner tubular member when the outer sleeve is in the first position.

14. The method of claim 1 wherein the nozzle assembly further comprises an O-ring disposed between the outer sleeve and inner tubular member for forming a fluid seal therebetween.

15. The method of claim 1 where the slidably movable outer sleeve of the nozzle assembly comprises at the distal end a tapered edge having a surface for contacting said exterior edge portion of the upper end of the cylindrical bore to thereby provide said sealing overlapping contact.

16. The method of claim 1 wherein the nozzle assembly further comprises a slidably movable outer sleeve, having a distal end, disposed around the inner tubular member, said distal end dimensioned for overlapping contact with an exterior edge portion of the upper end of the cylindrical bore when said viscous fluid flows radially through said at least one outlet.

17. The method of claim 16 wherein said outer sleeve is normally biased to a first position sealing said at least one outlet from the exterior, and slidably movable to the second position unsealing said at least one outlet while providing sealing overlapping contact with the edge portion of the cylindrical bore as the closed end of the inner tubular member is inserted into the cylindrical bore, wherein the viscous fluid flow radially through said at least one outlet to contact the sidewall of the cylindrical bore to provide said coating while the viscous fluid is prevented from flowing beyond the upper end of the cylindrical bore and from flowing away from the sidewall.

* * * * *